United States Patent [19]

Gill, Jr.

[11] Patent Number: 4,811,522

[45] Date of Patent: Mar. 14, 1989

[54] COUNTERBALANCED POLISHING APPARATUS

[76] Inventor: Gerald L. Gill, Jr., 3502 E. Atlanta Ave., Phoenix, Ariz. 85040

[21] Appl. No.: 29,133

[22] Filed: Mar. 23, 1987

[51] Int. Cl.[4] ..... B24B 5/00

[52] U.S. Cl. ..... 51/131.1; 51/131.4; 51/165.9

[58] Field of Search ..... 51/98.5, 99, 129, 165.92, 51/165.78, 165.9, 131.1, 131.2, 131.3, 131.4, 131.5; 125/13.55, 30, 30 R

[56] References Cited

U.S. PATENT DOCUMENTS 1,493,787 5/1924 Little ..... 51/99

1,800,307 4/1931 Marschke ..... 51/99

3,897,660 8/1975 Chijiwa ..... 51/165.92

4,313,284 2/1982 Walsh ..... 51/131.4

*Primary Examiner*—Frederick R. Schmidt

*Assistant Examiner*—Blynn Shideler

*Attorney, Agent, or Firm*—Nissle & Leeds

[57] ABSTRACT

Improved polishing apparatus. The apparatus includes a polishing head which holds a semiconductor wafer against a polishing surface. The apparatus permits the accurate application in small increments of pressure to the semiconductor wafer and provides a polishing head which "floats" and quickly reacts to and compensates for minor variations in the contour of the polishing surface contacting the semiconductor wafer.

7 Claims, 4 Drawing Sheets

COUNTERBALANCED POLISHING APPARATUS

This invention relates to polishing apparatus.

More particularly, the invention relates to apparatus for polishing a side of a thin, flat wafer of a semiconductor material, the apparatus including a polishing head which holds the wafer against a wetted polishing surface under pressure, and which rotates and oscillates the wafer over the polishing surface.

In a further respect, the invention relates to apparatus of the type described in which the polishing head can readily "float" and change orientation to rapidly respond to and compensate for minor irregularities in the polishing surface.

In another respect, the invention relates to apparatus of the type described in which the pressure of the polishing head against the semiconductor wafer can be finely adjusted in small increments to facilitate control of the magnitude of the force pressing the wafer against the polishing surface.

In still a further respect, the invention relates to apparatus of the type described in which the downward force holding the wafer against the polishing surface under pressure is transmitted to the wafer through an edge contact in the polishing head, the application of force through the edge contact more uniformly distributing over the wafer—polishing surface interface the pressure applied by the polishing head.

Apparatus for polishing thin, flat semiconductor wafers is well known in the art. See, for example, U.S. Pat. Nos. 3,841,031 to Walsh and 4,193,226 to Gill, Jr. et al. Such apparatus includes a polishing head which carries a semiconductor wafer and presses the wafer downwardly against a wetted polishing surface. The polishing head rotates and oscillates the wafer over the polishing surface. The polishing head is forced downwardly toward the polishing surface by an air cylinder or a comparable mechanism. A particular problem encountered in the use of such apparatus is maintaining a uniform downward pressure on the semiconductor wafer while the wafer travels over the polishing surface. The air cylinder used to force the polishing head and wafer against the polishing surface is not rigid and, like a shock absorber in an automobile, gives so that the polishing head can, to a certain extent, float and compensate for irregularities in the polishing surface. However, frictional forces in the air cylinder tend to resist displacements of the polishing head which would compensate for minor variations in the polishing surface. Such minor variations in the polishing surface, if not compensated for, can form undulations on the polished surface of the semiconductor wafer. This is particularly the case for soft semiconductor materials like gallium arsenide.

While it is desirable to have a polishing head which is sensitive to variations in the polishing surface, it is also desirable at the beginning of a polishing operation to be able to apply a pressure to the semiconductor wafer which is different than the pressure applied to the wafer at the end of the polishing operation. As a result, throughout the polishing operation it is advantageous to be able gradually continuously adjust in small increments the pressure forcing the semiconductor wafer against the polishing surface.

Accordingly, it would be highly desirable to provide improved semiconductor polishing apparatus of the general type described which would permit the accurate application in small increments of pressure to a semiconductor wafer and which would provide a polishing head which would "float" and quickly react to and compensate for minor variations in the contour of a polishing surface contacting the semiconductor wafer.

Therefore, it is a principal object of the invention to provide improved apparatus for polishing a surface of a flat, semiconductor wafer.

Another object of the invention is to provide improved semiconductor wafer polishing apparatus which includes a polishing head for carrying a semiconductor wafer and rotating and oscillating the wafer under pressure over a polishing surface.

A further object of the invention is to provide an improved polishing apparatus of the type described in which the pressure of the polishing head can be adjusted in small increments and in which the polishing head "floats" on a polishing surface and is sensitive to and quickly vertically alters position in response to variations in the contour of the polishing surface.

Still another object of the instant invention is to provide improved semiconductor wafer polishing apparatus of the type described in which the polishing head more uniformly distributes downward pressure over the entire semiconductor wafer—polishing surface interface.

These and other, further and more specific objects and advantages of the invention will be apparent to those skilled in the art from the following detailed description thereof, taken in conjunction with the drawings, in which.

Figure 1:
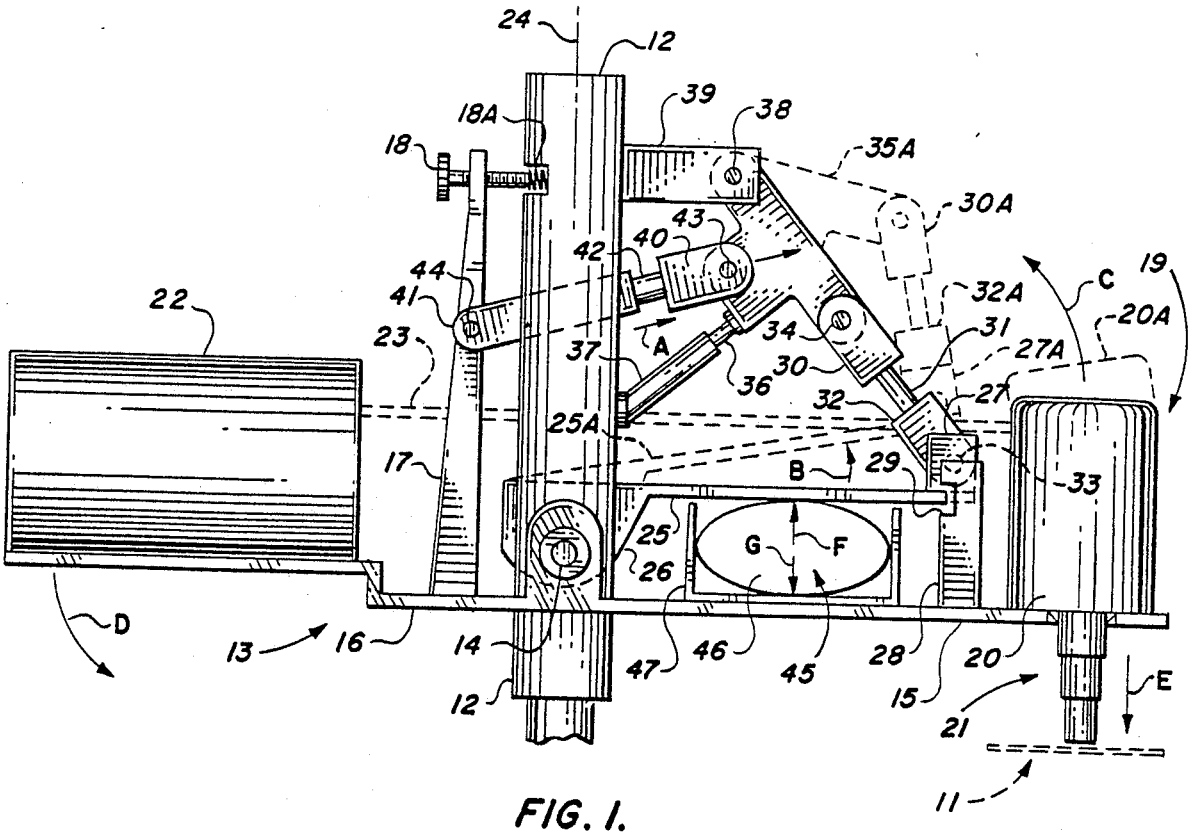
FIG. 1 is a front elevation view of polishing apparatus constructed in accordance with the principles of the invention.

Briefly, in accordance with my invention , I provide apparatus for polishing a surface of a thin, flat wafer of a semiconductor material. The apparatus includes at least one station having a substantially flat polishing surface; a frame; elongate carrier means mounted on the frame to pivot about a point thereon and including a first portion extending outwardly to one side of the pivot point, a second portion extending to the other side of the pivot point, and a floating pressure head carried on the first end of the carrier means and having a lower portion for maintaining the wafer in contact with the head; resilient expandable means intermediate and contacting the frame and the elongate carrier means and expanding against the carrier means between at least two operative positions, a first operative position causing the carrier means to apply a first pressure to the floating head to hold the wafer in contact with the polishing surface, and a second operative position causing the carrier means to apply to the floating head and wafer a second pressure different than the first pressure; and, counterweight means mounted on the second portion of the carrier means such that the counterweight means and the second portion of the carrier means generally counterbalance the first portion of the carrier means and the pressure head. At least one of the polishing surface and the pressure head is rotatable.

In another embodiment of my invention, I provide improved apparatus for polishing a surface of a thin, flat wafer of a semiconductor material. The apparatus includes at least one station having a substantially flat polishing surface; a frame; elongate carrier means pivotally mounted on the frame; and, a floating pressure head mounted on the carrier means over the polishing surface. The pressure head includes a base including a lower portion for maintaining the wafer in contact therewith and against the polishing surface and includes an upper portion having a planar surface area; a force transmitting member connected to the base and having an upper planar surface, a lower surface, and edge means at the periphery of the lower surface and contacting the planar surface area of the base; and, a rod mounted on the carrier means and including an upper end and a lower planar end contacting the upper planar surface of the force transmitting member. The lower planar end of the rod includes a periphery and presses against the upper planar surface of the force transmitting member. The pressure of the rod against the upper planar surface of the force transmitting member is transmitted to the base through the edge means to press the wafer against the polishing surface. The base and force transmitting member move between at least two operative positions with respect to the lower planar end of the rod, a first operative position with the lower planar end of the rod contacting and generally parallel to the upper planar surface of the force transmitting member; and, a second operative position with respect to the lower planar end of the rod such that the power planar end of the rod is canted away from and only contacts the upper planar surface at points on the periphery of the lower planar end. At least one of the polishing surface and the pressure head rotate.

Turning now to the drawings, which depict the presently preferred embodiments of the invention for the purpose of illustrating the practice thereof and not by way of limitation of the scope of the invention, and in which like reference characters refer to corresponding elements throughout the several views, FIGS. 1 to 7 illustrate polishing apparatus constructed in accordance with the principles of the invention and including a polishing surface 11, frame 12, and carrier means 13 attached to frame 12 at pivot point 14. Carrier means 13 includes first portion 15 extending to one side of pivot point 14 and second portion 16 extending to the other side of pivot point 14. Second portion 16 includes upwardly extending substantially rigid arm 17. Externally threaded set screw 18 turns through an internally threaded aperture in arm 17 against resilient compressed spring 18A. Pressure head assembly 19 is mounted on portion 15 of the carrier means 15 and includes housing 20 and rotatable rod 21 extending downwardly from carrier means 15. The upper end of rod 21 extends into housing 20 and is operatively associated with means for transmitting motive power to rod 21. Motive power for rotating rod 21 is provided by counterbalance or motor 22 carried on portion 16 of carrier means 15. Dashed lines 23 represent gearing or other means used to transmit motive power from motor 22 to the means in housing 20 which supply motive power to rod 21. Means (not shown) can also be supplied to rotate frame 12 about axis 24 such that rod 21 and a pressure head carried on rod 21 can be laterally oscillated over polishing surface 11. Polishing surface 11 can be mounted on frame 12 or can be supported on framework independent of frame 12.

Arm 25 is fixedly connected to and outwardly extends from cam-shaped plate 26. Plate 26 is carried on the back of frame 12 at pivot point 14. Rectangular panel 27 is connected to and upwardly extends from arm 25. Panel 27 is positioned behind upwardly extending finger 28 of portion 15. U-shaped mouth 29 in finger 28 receives and bounds the end of arm 25. Links 30 and 32 are interconnected by arm 31. Link 32 is pivotally connected 33 to panel 27. Link 30 is pivotally connected 34 to T-shaped panel member 35. Stop 36 is fixedly connected to member 35 and in FIG. 1 is shown resting against stop 37 fixedly connected to frame 12. Member 35 is pivotally connected 38 to arm 39 fixedly attached to and extending outwardly from frame 12. Plunger 42 of hydraulic piston 41 is fixedly attached to link 40. Link 40 is pivotally attached 43 to member 35. Hydraulic piston 41 is pivotally attached 44 to arm 17. Hydraulic fluid or any other appropriate fluid can be utilized to operate piston 41. The hydraulic or pneumatic lines leading to piston 41 have been omitted from FIG. 1 for the sake of clarity. When hydraulic piston 41 is operated to outwardly displace plunger 42 in the direction of arrow A, member 35, links 30 and 32, and panel 27 are displaced in the manner indicated by dashed lines 35A, 30A, 32A and 27A in FIG. 1, and arm 25 moves upwardly in the direction of arrow B to the position indicated by dashed lines 25A. The outer end of arm 25 contacts the upper part of mouth 29 when arm 25 moves in the direction of arrow B. When the outer end of arm 25 contacts mouth 28, the carrier means is pivoted about pin 14, housing 29 moves upwardly in the direction of arrow C (as also indicated by dashed lines 20A), and portion 16 moves downwardly in the direction of arrow D. Accordingly, extending plunger 42 in the direction of arrow A causes pressure head assembly 19 to be upwardly displaced away from polishing surface 11. Means for rotating or oscillating polishing surface 11 are well known in the art and are omitted from FIG. 1 for the sake of clarity.

Figure 2A:
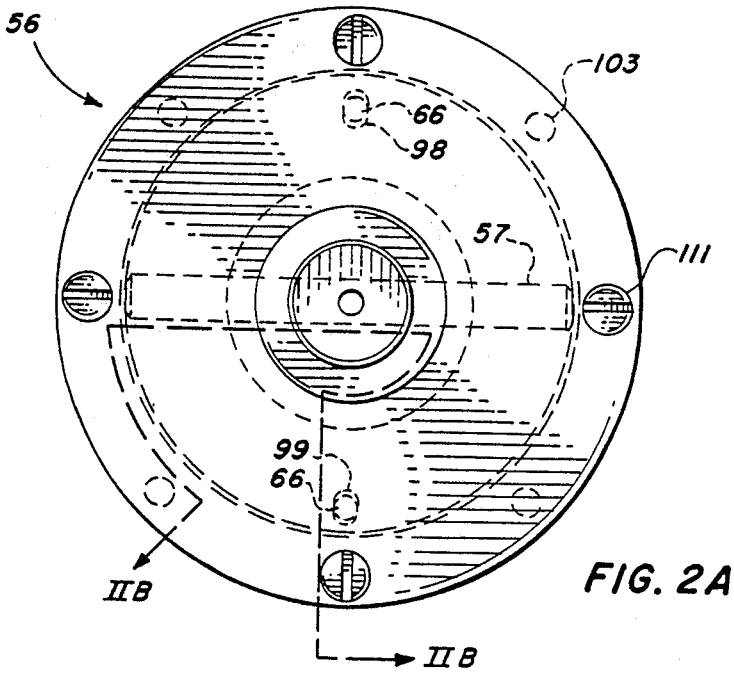
FIG. 2A is a top view of the polishing head of the apparatus of FIG. 1.
Figure 2B:
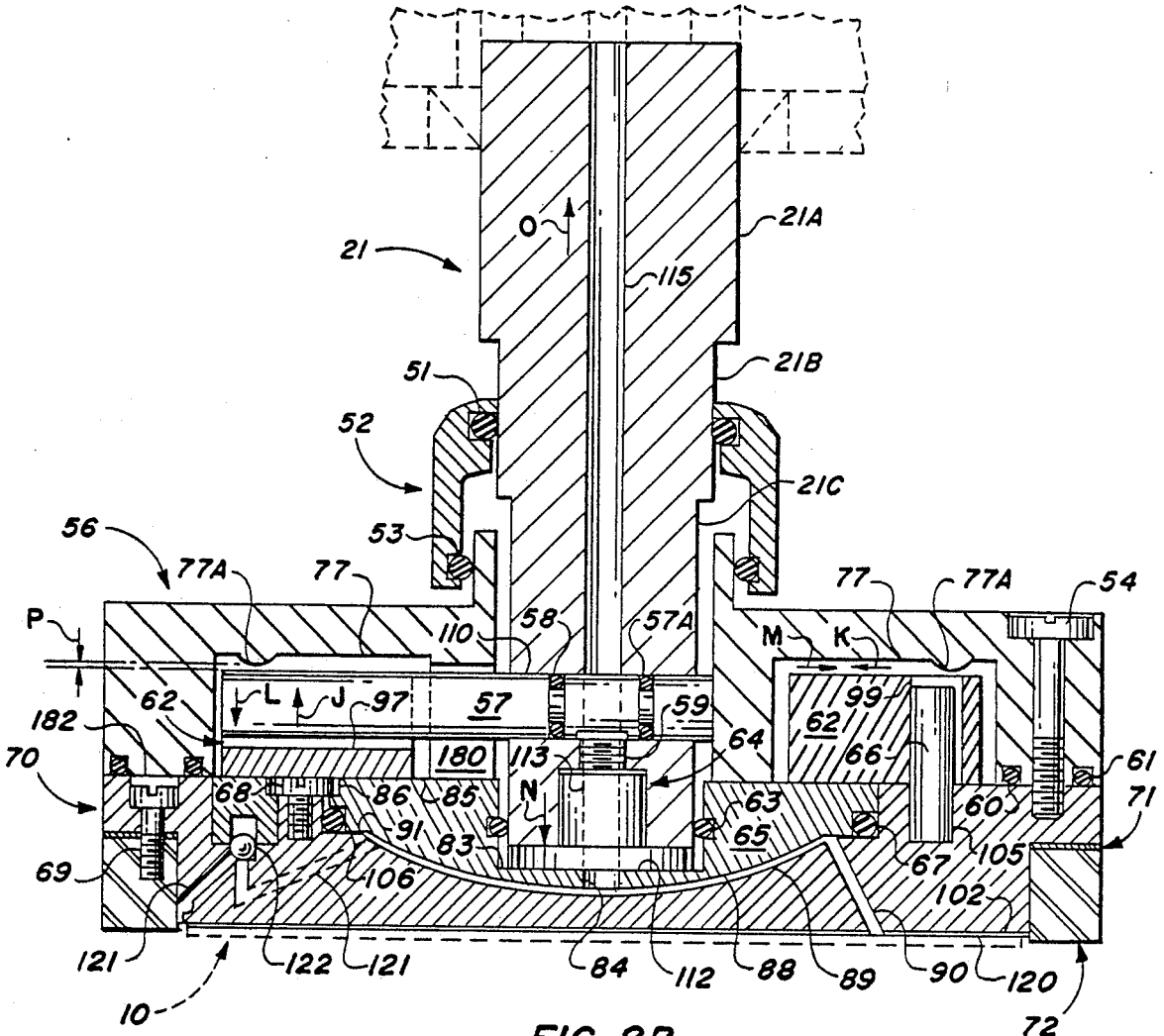
FIG. 2B is a section view of the polishing head of FIG. 2A taken along section line 2B—2B thereof and further illustrating interior construction details thereof.
Figure 3:
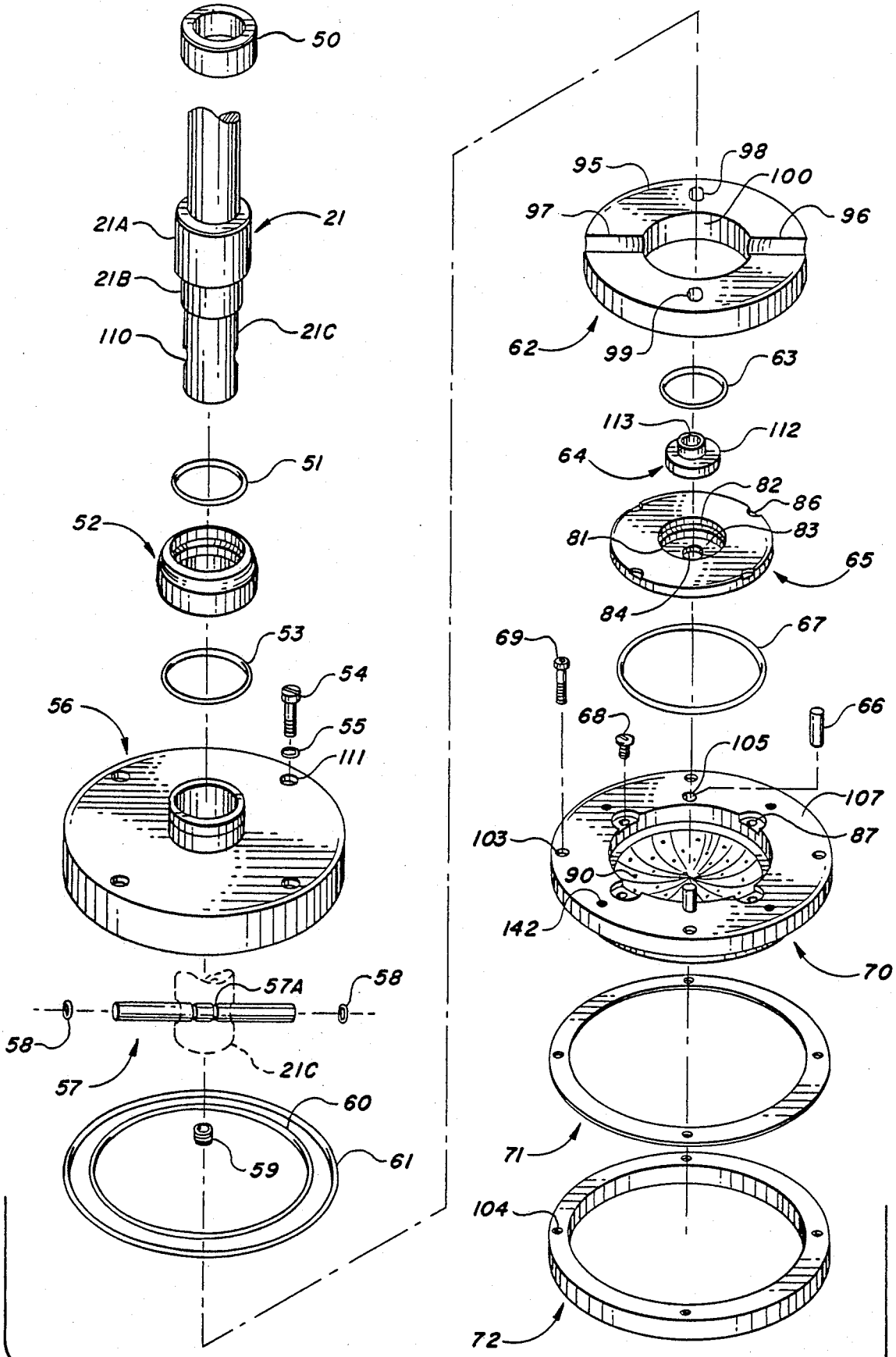
FIG. 3 is an exploded assembly view illustrating the polishing head of FIGS. 2A and 2B.

When carrier means 13 is generally horizontally disposed in the manner illustrated in FIG. 1, resilient inflatable/deflatable bladder means 45 is used to increase or decrease the downward pressure E on the polishing head carried on rod 21. The polishing head carried on rod 21 is illustrated in FIGS. 2A, 2B and 3. Bladder means 45 includes bladder 46 and U-shaped housing 47 for bladder 46. In FIG. 1 bladder 46 has not been inflated sufficiently to exert a force F against arm 25 and a force G against portion 15 of carrier means 13. The means for inflating and deflating bladder 46 with air or another fluid is well known in the art and has, for the sake of clarity, been omitted from FIG. 1. When resilient expandable bladder 46 is inflated, it expands outwardly against arm 25 and portion 15 of carrier means 13. The force F generated by the expanded bladder 46 against arm 25 does not cause arm 25 to move because member 35 and links 30 and 32 maintain arm 25 in fixed position. The force G generated against portion 15 by expanded bladder 46 increases the downward force E on the polishing head carried by rod 21 and may cause portion 15 to slightly move downwardly due to the increased compressive pressure on the wafer carried by the polishing head and on polishing surface 11. Before bladder 46 is expanded to increase the downward force E on the polishing head, the weight of the counterbalance 22 is normally adjusted such that it, along with portion 16 generally offsets the weight of arm portion 15 and pressure head assembly 19; provided, however, that the weight of counterbalance 22 and portion 16 is slightly less than the weight of portion 15 and pressure head assembly 19 such that there is a slight downward force or bias E acting on the polishing head. As would be appreciated by those of skill in the art, bladder 46 can be inflated and deflated to increase, and then decrease, the force E acting on the polishing head in small increments. Set screw 18 can also be turned toward or away from spring 18A and frame 12 to decrease or increase, respectively, the downward force E on the polishing head.

The polishing head normally carried on rod 21 is illustrated in FIGS. 2A, 2B and 3 and includes ring 50, rod 21, O-ring 51, sleeve 52, O-ring 53, bolts 54, washers 55, cover 56, cylindrical rod 57 with circular grooves 57A, O-rings 58 for grooves 57A, O-rings 60 and 61 for grooves 73 and 74 in cover 56 (FIG. 4), threaded setscrew 59, retainer ring 62, O-ring 63, foot 64, force transmitting member 65, O-ring 67, base 70, screws 68 and 69, pins 66, spacer 71, and lip 72.

Figure 4:
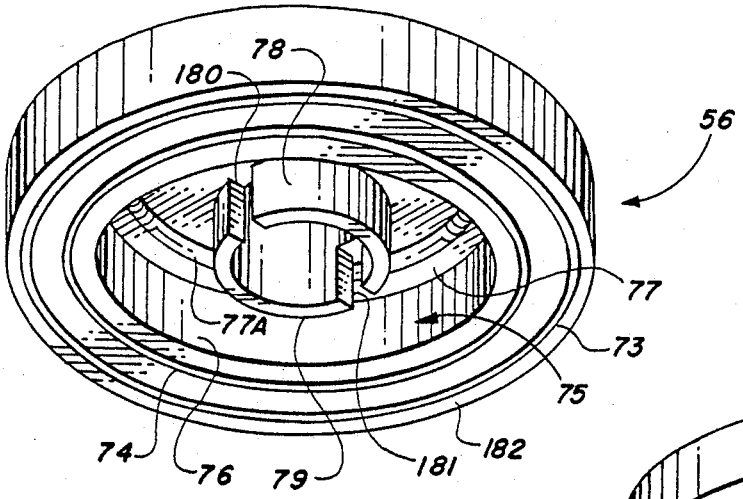
FIG. 4 is a perspective view further illustrating one of the components of the polishing head of FIG. 3.

As shown in FIG. 4, cover 56 includes indent 75 having cylindrical wall 76 and floor 77. Circular rim 77A is fixedly connected to and outwardly extends from floor 77. Generally semicircular wall portions 78 and 79 bound U-shaped slots 180 and 181. Circular groove 73 and 74 are formed in planar circular surface 182.

Force transmitting member 65 (FIG. 5) includes apertures 81 and 84, circular upper planar surfaces 83 and 85, and circular groove 82. Indents 86 receive a portion of the heads of screws 68 threaded into apertures 87 of base 70. Lower convex spherically shaped surface 88 of member 65 is spaced apart from and opposed to concave spherically shaped surface 89 of base 70. Circular planar surfaces 92 and 91 are parallel and interconnected by cylindrical surface 93. Surface 93 is generally perpendicular to surfaces 91 and 92 and is parallel to peripheral surface 94.

Figure 6:
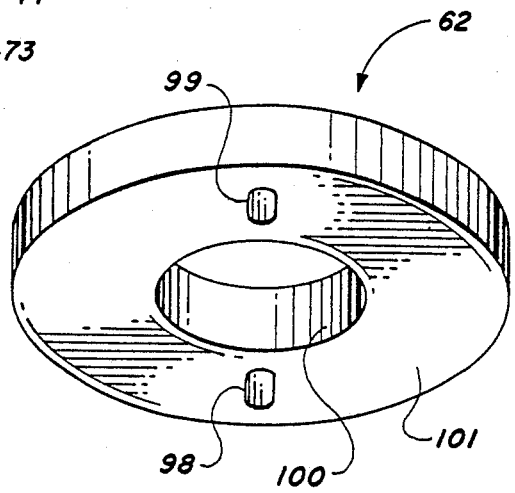
FIG. 6 is a perspective view further illustrating still another of the components of the polishing head of FIG. 3.
Figure 5:
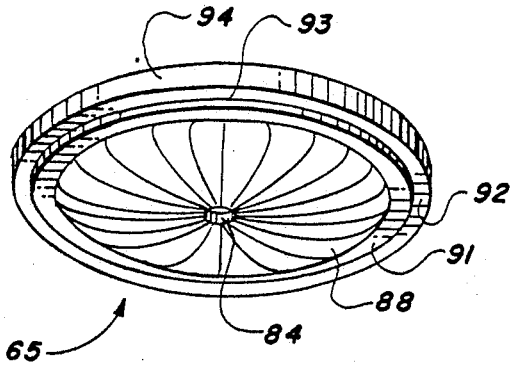
FIG. 5 is a perspective view further illustrating another of the components of the polishing head of FIG. 3.

In FIGS. 3 and 6 , retainer ring 62 includes upper planar circular surface 95, U-shaped slots 96 and 97, and elongate apertures 98 and 99. Apertures 98 and 99 have parallel spaced apart side walls and semi-circular ends. Cylindrical aperture 100 extends through member 62 from upper surface 95 to lower planar circular surface 101.

Figure 7:
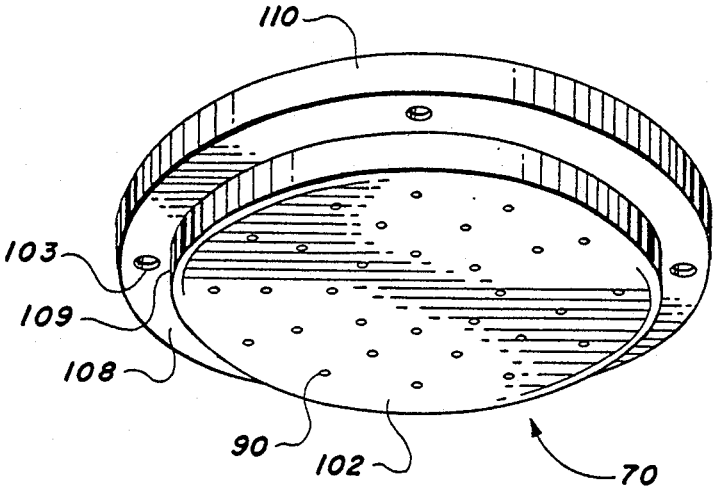
FIG. 7 is a perspective view further illustrating yet another of the components of the polishing head of FIG. 3.

In FIGS. 3 and 7, base 70 includes apertures or perforations 90 extending from concave surface 89 to planar, circular lower surface 102. Apertures 103 slidably receive bolts 69. Bolts 69 thread into internally threaded apertures 104 of lip 72. Pins 66 are fixedly press fit in apertures 105. Circular planar surface 106 is parallel to circular planar surface 107, to surface 102, and to circular planar surface 108. Cylindrical surfaces 109 and 110 are parallel to one another and perpendicular to surface 102.

In FIG. 3, pin 57 is slidably received by aperture 110 formed through rod 21. Setscrew 59 secures pin 57 in aperture 110. Bolts 54 are slidably received by apertures 111 in cover 56 and are threaded into apertures 142 in base 70. Foot 64 includes lower circular planar surface 112. Aperture 113 is formed through foot 64.

As can be seen in FIG. 2B, lip 72 is attached to base 70 with screws 69. Circular lip or edge 91 of member 65 is tightened against planar surface 106 of base 70 with screws 68. Cover 56 is attached to base 70 with screws 54. Retainer ring 62, however, is mounted intermediate cover 56 g and base 70 and is not connected to cover 56, member 65, base 70 or any other member of component of the polishing head of FIG. 2B. Consequently, retainer ring 62 can slide over surface 85 in the directions indicated by arrows M and K in FIG. 2B. In FIG. 3, arrows M and K would, if shown, lie along a line which lies in the horizontal plane passing through surface 95. The line would also pass through the center of the ends or mouths of apertures 98 and 99 opening at surface 95 In other words, arrows M and K are perpendicular to slots 96 and 97 and to pin 57. Pin 57 is slidably received by slots 96 and 97.

In FIG. 2B foot 64 rests on but is not connected to planar surface 83. Downward pressure N exerted on foot 64 by rod 21 forces planar surface 112 against surface 83 of member 65. If the downward pressure N by rod 21 is discontinued, and rod 21 is displaced in the direction of arrow O, rod 21 and pin 57 move upwardly away from surface 83 a short distance indicated by arrows P. Arrows P represent the distance pin 57 can slide upwardly through groove 96 and 97 before contacting and being stopped by circular rim 77A.

Figure 2C:
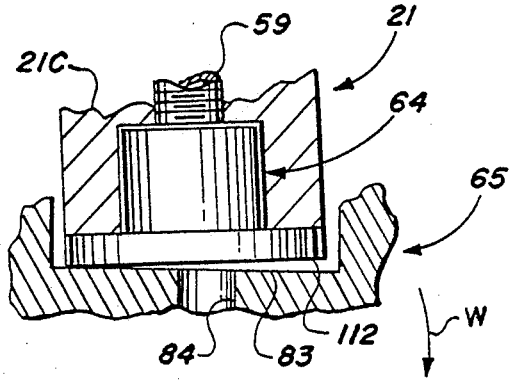
FIG. 2C is an enlarged view of a pressure imparting component of the polishing head of FIG. 2 illustrating the mode of operation thereof.
Figure 2D:
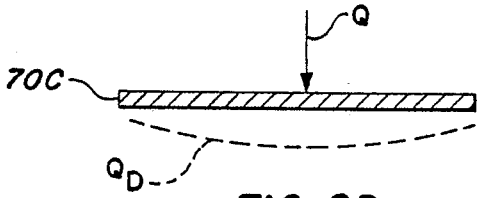
FIG. 2D is a simplified illustration of a polishing head illustrating the normal pressure distribution produced by application of a downward force to the head at a point centered in the polishing head.
Figure 2E:
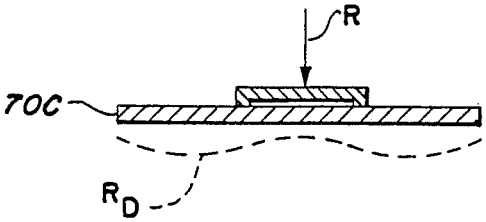
FIG. 2E is a simplified illustration of a polishing head illustrating the normal pressure distribution produced by application of a downward force at points intermediate the center and periphery of the polishing head.

When a semiconductor wafer, indicated by dashed lines 10 in FIG. 2B, is maintained under pressure against polishing surface 11 by the polishing head, rod 21 normally maintains a generally fixed vertical orientation. Cover 56, member 65 and base 70 of the polishing head can, in compensating for irregularities in the polishing surface, simultaneously cant with respect to rod 21 and member 64. This canting is illustrated in exaggerated fashion in FIG. 2C. As illustrated in FIG. 2C, when base 70 and upper planar surface 83 cant away from planar surface 112 in the direction indicated by arrow W, points on the periphery of surface 112 maintain contact with surface 83. When member 65 and base 70 cant with respect to rod 21 and member 64, retainer ring 62 can cant with base 70 and the vertical sides of slots 96 and 97 can slide over pin 57. Such tilting of retainer ring 62 with respect to pin 57 is possible because while pin 57 slidably contacts the vertical sides of slots 96 and 97, pin 57 is normally positioned in slots 96 and 97 in a position spaced above the bottom surfaces of slots 96 and 97. The normal position of pin 57 spaced above the bottoms of slots 96 and 97 is illustrated in FIG. 2B.

Pins 66 each slidably contact the parallel opposed flat planar sides of an aperture 98 or 99. Apertures 98 and 99 are longer than the diameter of pins 66 (see FIG. 2B), which permits ring 62 to slide back and forth or to tilt up and down short distances with respect to pins 66.

The downward force N applied to surface 83 by rod 21 and member 64 is transmitted by member 65 to base 70 through circular edge surface 91 contacting circular planar surface 106 of base 70. Transmitting force N through circular edge surface 91 more uniformly distributes force N over the wafer 10—polishing surface 11 interface. This uniform distribution of force N is explained with reference to FIGS. 2D and 2E. When, in FIG. 2D, a force Q is applied to the center point of a polishing head base 70C, the distribution of force Q along the bottom of the base can be approximated by dashed line $Q_D$. As indicated by $Q_D$, the resulting forces along the bottom of base 70C are greatest at the center of the base and decrease as points nearer the periphery of the base 70C are selected. When in FIG. 2E, a force R is applied to a force transmitting member with edge contacts intermediate the periphery and center of base 70C, then the force distribution $R_D$ along the bottom of base 70C is more uniform. An additional virtue of the polishing head construction of FIGS. 2B and 3 is that it permits the interface between surfaces 112 and 83 to be positioned near the bottom surface 102 of base 70, producing a more stable polishing head.

As illustrated in FIG. 2B, a thin circular piece of Rodel "40 film" backing material is attached to surface 102 of base 70. The poromeric "40 film" is attached by compressing it between a hot smooth metallic surface and surface 102. Compression of the "40 film" ordinarily reduces the original thickness of the film by 40% to 60% and makes the film relatively stiff. The heat compression of the "40 film" also produces a smooth outer surface on the film for contacting wafer 10. "40 film" is produced by Rodel Products Corporation of 9495 East San Salvador Drive, Scottsdale, Ariz. 85258.

As noted earlier, apertures 90 are formed through base 70. These apertures also extend through layer 120 of the Rodel "40 film". Liquid is directed under pressure through apertures 115 (in rod 21), 113 and 84 into the space between surfaces 88 and 89. The liquid then flows through apertures 90 to wet a wafer being placed against the "40 film". When semiconductor wafer 10 is contacted with layer 120, suction can be applied to apertures 115, 113, 84, and, accordingly, 90, to maintain wafer 10 in contact with layer 120. Check valve 122 permits water to flow through apertures 115, 113, 84 and 121 to the periphery of wafer 10. Valve 122 closes when suction is applied to aperture 115. This suction would , if valve 122 did not close, tend to draw fluid in the direction of arrow 0. When, as earlier described, fluid is directed through aperture 115 under pressure to wet a wafer, the fluid flows in a direction of travel opposite the direction indicated by arrow O.

In use, a polishing head is attached to rod 21 in FIG. 1. A wafer 10 is interposed between the polishing head and surface 11. The counterbalance 22 is adjusted such that the pressure head assembly 19 and portion 15 are slightly heavier than counterbalance 22 and portion 16. This biasing of the pressure head assembly gently holds wafer 10 under pressure against polishing surface 11. Rod 21 is rotated and/or oscillated and polishing surface 11 is rotated and/or oscillated. Bladder 46 is expanded and contracted as desired to alter the magnitude of downward force E on wafer 10. Set screw 18 and spring 18A are used as desired to finely adjust the magnitude of force E. During polishing of wafer 10, base 70 of the polishing head cants in the manner earlier described to compensate for variations in polishing surface 11. Bladder 26 also functions as a very sensitive shock absorber to absorb and soften any minor vertical displacements of the polishing head during polishing of wafer 10.

The polishing apparatus of the invention can be utilized to polish wafers of glass, ceramics, plastics, and other materials. One or both of surfaces 102 and 11 can be concave, convex or otherwise contoured to polish lens-shaped surfaces or other contoured surfaces on a wafer of material.

Having described my invention in such terms as to enable those skilled in the art to understand and practice it, and having identified the presently preferred embodiments thereof, I claim:

1. Apparatus for polishing a surface of a thin wafer of a material, comprising (a) at least one station having a polishing surface;

(b) a frame;

(c) elongate carrier means pivotally mounted on said frame;

(d) a floating pressure head mounted on said carrier means over said polishing surface and including (i) a base including a lower portion for maintaining the wafer in contact therewith and against said polishing surface, and an upper portion having a planar surface area, (ii) a force transmitting member contacting said base and having an upper planar surface, a lower surface, and edge means at a periphery of said lower surface and contacting said planar surface area of said base, and (iii) a rod mounted on said carrier means and including an upper end and a lower end with a flat bottom planar surface contacting said upper planar surface of said force transmitting member, said bottom planar surface of said rod including a circular peripheral edge and pressing against said upper planar surface of said force transmitting member, said pressure of said bottom surface of said rod against said upper planar surface of said force transmitting member being transmitted to said base through said edge means to press said wafer against said polishing surface;

said base and force transmitting member moving between at least two operative positions with respect to said lower planar end of said rod, (e) a first operative position with said flat bottom surface of said rod contacting and parallel to said upper planar surface of said force transmitting member; and, (f) a second operative position with said base and force transmitting member canted with respect to said flat bottom surface of said rod such that said flat bottom surface of said rod is canted away from and only contacts said upper planar surface at points on said circular periphery of said lower planar end, at least one of said polishing surface and said pressure head being rotatable.

2. The apparatus of claim 1 wherein when said base and force transmitting member are in said first operative position, said flat bottom planar surface of said rod is a shorter distance from said than is said edge means.

3. The apparatus of claim 2 including (a) a housing attached to said base and (i) having a floor surface, and (ii) at least partially enclosing a defining a space intermediate said floor surface of said housing and a slot formed in said base, said space extending outwardly from said rod and being above said edge means and said flat bottom planar surface of said rod;

(b) an elongate member attached to and extending outwardly from said rod into said space and having at least two orientations with respect to said floor surface and said base, (i) a first orientation when said base and force transmitting member are in said first operative position, said rod member extending into said space and being spaced apart from said floor surface and said base when in said primary operative position, and, (ii) a second orientation when said base force transmitting member are in said second operative position and one of said base and force transmitting member has canted toward said elongate member while the other of said base and force transmitting member has canted away from said elongate member.

4. Apparatus for polishing a surface of a thin wafer of material, comprising (a) at least one station having a polishing surface;

(b) a frame;

(c) elongate horizontally oriented carrier means mounted on said frame to pivot about a point thereon and including (i) a first portion extending outwardly to one side of said pivot point, (ii) a second portion extending to the other side of said pivot point, (iii) a floating pressure head carried on said first portion of said carrier means over said polishing surface and including a base including a lower portion for maintaining the wafer in contact therewith and against said polishing surface, and an upper portion having a planar surface area, a force transmitting member contacting said base and having an upper planar surface, a lower surface, and edge means at a periphery of said lower surface and contacting said planar surface area of said base, and a rod mounted on said carrier means and including an upper end and a lower end with a flat bottom planar surface contacting said upper planar surface of said force transmitting member, said bottom planar surface of said rod including a circular peripheral edge and pressing against said upper planar surface of said force transmitting member, said pressure of said bottom surface of said rod against said upper planar surface of said force transmitting member being transmitted to said base through said edge means to press said wafer against said polishing surface, base and force transmitting member moving between at least two operative positions with respect to lower planar end of said rod, a first planar end operative position with said flat bottom surface of said rod contacting and parallel to said upper planar surface of said force transmitting member;

a second planar end operative position with said base and force transmitting member canted with respect to said flat bottom surface of said rod such that said flat bottom surface of said rod is canted away from and only contacts said upper planar surface at points on said circular periphery of said lower planar end;

(d) resilient expandable adjustment means intermediate and contacting said frame and said elongate horizontally oriented carrier means and expandable against said carrier means during utilization of said apparatus and floating pressure head to polish said surface of said wafer to move said carrier means between at least two operative positions, (i) a first adjustment operative position causing said carrier means to apply a first pressure to said floating head to hold the wafer in contact with the polishing surface under pressure, and, (ii) a second adjustment operative position causing said carrier means to apply to said floating head and wafer a second pressure to hold the wafer in contact with the polishing surface under pressure, said second pressure being different than said first pressure; and, (e) counterweight means mounted on said second portion of said carrier means such that said counterweight and said second portion of said carrier means generally counterbalance said first portion of said carrier means and said pressure head, at least one of said polishing surface and said pressure head being rotatable.

5. The apparatus of claim 4 wherein when said base and force transmitting member are in said first operative position, said flat bottom planar surface of said rod is a shorter distance from said wafer than is said edge means.

6. The apparatus of claim 5 including (a) a housing attached to said base and (i) having a floor surface, and (ii) at least partially enclosing and defining a space intermediate said floor surface of said housing and said base, said space extending outwardly from said rod and being above said edge means and said flat bottom planar surface of said rod;

(b) an elongate member extending outwardly from said rod into said space and having at least two orientations with respect to said floor surface and said base, (i) a first orientation when said base and force transmitting member are in said first planar end operative position, said rod member extending into said space and being spaced apart from said floor surface and said base when in said first orientation, and, (ii) a second orientation when said base and force transmitting member are in said second planar end operative position and one of said base and force transmitting member has canted toward said elongate member while the other of said base and force transmitting member has canted away from said elongate member.

7. The apparatus of claim 6, wherein said elongate rod extends into a slot formed in said base and bears laterally against said slot to prevent rotation of said base and wafer about said rod.

* * * * *